United States Patent [19]

Cannella

[11] Patent Number: 4,807,302

[45] Date of Patent: Feb. 28, 1989

[54] HAND PROTECTOR WITH GRIPPING MEANS

[76] Inventor: Alexander Cannella, 541 Dawson Rd., Delmar, N.Y. 12054

[21] Appl. No.: 115,992

[22] Filed: Nov. 3, 1987

[51] Int. Cl.[4] ..... A41D 13/10

[52] U.S. Cl. ..... 2/16; 2/161 A

[58] Field of Search ..... 2/16, 20, 160, 161 R, 2/161 A

[56] References Cited

U.S. PATENT DOCUMENTS

| | | | |
|---|---|---|---|
| 1,243,622 | 10/1917 | Nielsen | 2/161 R |
| 2,538,889 | 1/1951 | Swarin | 2/21 |
| 2,616,745 | 11/1952 | Alston | 2/161 R |
| 2,717,799 | 9/1955 | Jones | 294/25 |
| 2,923,946 | 2/1960 | Nielsen | 2/161 |
| 3,228,033 | 6/1966 | Ames et al. | 2/21 |
| 3,328,029 | 6/1967 | Paige | 273/54 |
| 3,398,951 | 8/1968 | Disko | 273/54 |
| 3,903,546 | 9/1975 | Rhee | 2/16 |
| 4,400,829 | 8/1983 | Willis | 2/16 |
| 4,497,073 | 2/1985 | Deutsch | 2/161 |
| 4,635,300 | 1/1987 | Rhee | 2/16 |

*Primary Examiner*—Louis K. Rimrodt

*Attorney, Agent, or Firm*—Schmeiser, Morelle & Watts

[57] ABSTRACT

A hand protector for use in the martial arts comprising a sheath of tough, abrasive and cutting resistant material for enveloping the full digit set of a wearer's hand. Means for gripping and for supporting a board or the like to be struck by a martial arts participant are provided on the outer surface of the palmside of the sheath. The inner surface of the sheath is textured roughly to prevent slippage of the wearer's hand within the device. A gripping bar may be provided within the sheath for grasping by the wearer's hand.

8 Claims, 2 Drawing Sheets

HAND PROTECTOR WITH GRIPPING MEANS

FIELD OF THE INVENTION

This invention relates generally to the field of hand protectors. More particularly, this invention is a finger and knuckle protector for use in the martial arts which has gripping means to hold a board or the like.

BACKGROUND OF THE INVENTION

An important aspect of martial arts training and exhibitions involves using one's hands or feet to break an object, such as a board, while it is being held by another participant. Although not necessarily recognized by an audience, the breaking of boards requires an interactive relationship between the kicker and holder. The holder cannot casually hold the board but must strongly grip the board, extend it to the appropriate area, and position body and arms to virtually lock the board in place. This requires, strength, proper form and concentration, the lack of anyone of which can cause injury. With the use of a wide variety of kicks, many of which involve the kicker hitting a blind target, hand injuries to those participants holding the boards is extremely high. Severe injuries to the fingers, knuckles and joints also often result from the poorly aimed kicks of trainees.

Furthermore, to avoid injuries to the kicker and to effect a clean break of the boards being hit, the boards must be held rigidly and straight. When a participant has been injured while holding boards, or even if he has simply seen others hit the holder becomes apprehensive. This may cause him to loosen his grip of the boards in which case the boards may be knocked loose which is even more dangerous. Similarly having too much give in the boards does not enable the kicker to move as cleanly through the boards and is more likely to injure the kicker. This apprehension may also cause the holder to "shy" away from the blow and inadvertently angle the boards. In such a case, a slightly misdirected blow could land along the edge of the board again injuring the kicker.

Nevertheless, to become proficient in the martial arts and to promote the sport, practice and exhibitions are necessary; therefore, without an adequate protective device, hand injuries have been accepted as part of martial arts.

One protective device that is available for use in the martial arts is disclosed by Rhee, U.S. Pat. No. 3,903,546. Rhee's invention is a protective glove to be worn by the participant who is delivering the blows. The glove covers the back and sides of the hand as well as the thumb and wrist of the wearer with a flexible material, thereby obviating injuries to the wearer's hand and to the bodies of participants who receive the blows. The palm side of the hand is left generally uncovered except for a loop or strap to hold the glove on the wearer's hand. Inasmuch as Rhee's invention is flexible and, therefore, suitable for use in striking blows with a fist or open hand, it is not suitable to protect the hand of a martial arts participant while, at the same time, enabling him to grip tightly a board or other object to be struck by another participant.

A device is needed which will adequately provide knuckle to fingertip protection to a martial arts participant who is holding a board or other object for another martial arts trainee or demonstrator to strike and to break. In order to sufficiently protect the wearer, such a device must be rigid enough to withstand high impact blows and cutting slices, while still enabling the wearer to grasp securely the object to be held. Further, gripping means for tightly and steadily holding the object should be incorporated.

The invention consists in the novel parts, constructions, arrangements, combinations and improvements herein shown and described.

SUMMARY OF THE INVENTION

The present invention is a hand protector for use in the martial arts to protect the hands, especially the portion extending from the finger tips to the knuckles, of one participant who is holding a board or other object to be struck by another participant.

The hand protector comprises a sheath having a dome-like portion and an underside for enveloping the full digit set of the user's hand. In order to provide adequate protection from high impact blows or slices of a cutting blade, the sheath is composed of a tough, abrasion and cutting resistant material, such as a high-impact resistant plastic or metal. For added protection, the outer surface of the dome-like portion may be padded. On the underside or palm-side of the sheath, a gripping plate having detents on its outer surface for tightly and securely gripping an object, such as a board, is attached. There is further provided a flange extending outwardly from the gripping plate to support the object to be held and to provide further hand protection.

Within the sheath, the inner surface of the gripping plate is textured roughly to prevent slippage of the user's hand. To further enable a secure grip on the board or other object, a support member mounted on the inner surface of the sheath projects outwardly therefrom for grasping between the two middle digits. Additionally, a gripping bar may be provided to be grasped by the user's digits Within the sheath for even more support of the object being held.

The accompanying drawings, referred to herein and constituting a part hereof illustrate preferred embodiments of the invention, and together with the description, serve to explain the principles of the invention.

DETAILED DESCRIPTION OF THE DRAWINGS

Figure 1:
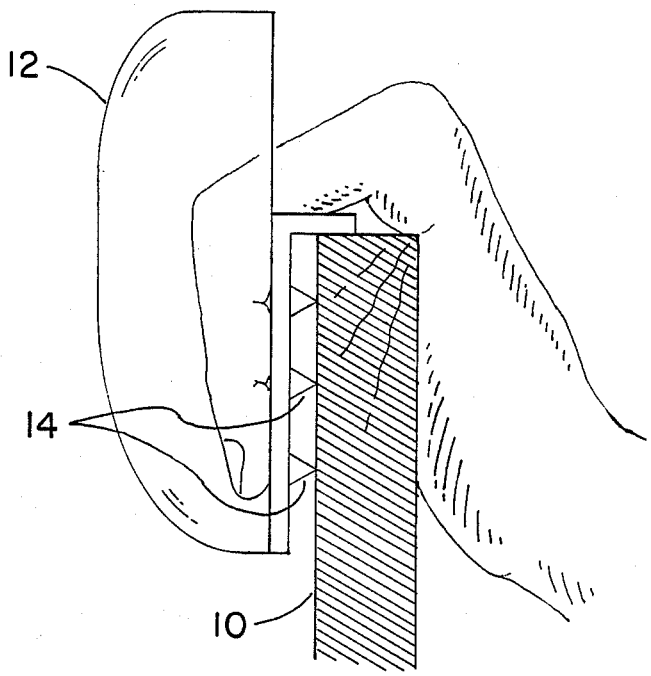
FIG. 1 is a side elevational view of the hand protector as worn by a user gripping a board.

With reference to FIG. 1, the hand protector of the present invention is shown as if in use by a martial arts participant who is holding a board 10 to be broken by another participant. As shown, the sheath 12 encloses the full digit set of the user's hand, thereby protecting the portion of the hand extending from the finger tips to the knuckles. The pointed detents 14 provide frictional gripping means to hold a board or other object tightly and steadily while another martial arts participant strikes a blow with a hand, a foot, or even a cutting blade in an attempt to break the object.

Figure 3:
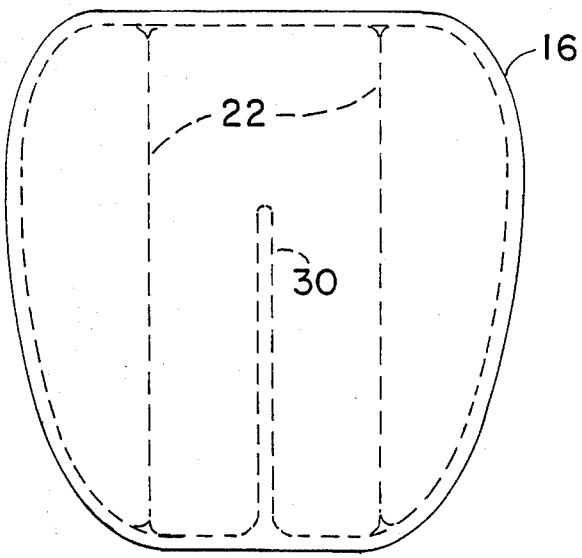
FIG. 3 is a back view of the hand protector.
Figure 4:
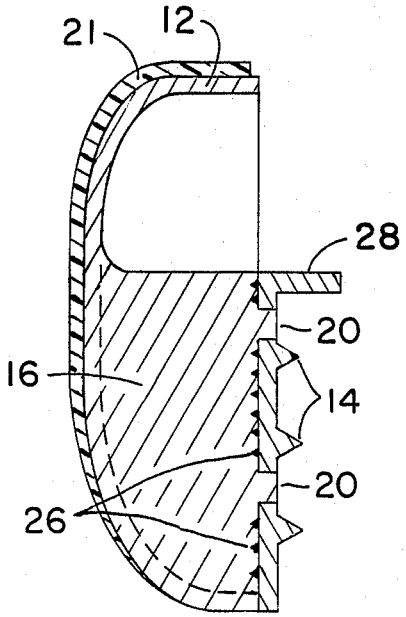
FIG. 4 is a side elevational view of the hand protector.

The sheath 12 of the hand protector is made of a tough, substantially nondeformable, abrasion and cutting resistant material, such as plastic or metal. In the preferred embodiment, the protective sheath, comprising an underside 18 and a semi ovoid, dome-like portion 16 molded together, is composed of a plastic material. By curving portion 16, impact against it will slide off to avoid injury to the hitter. Ribs 22, as shown in FIG. 3, are provided for additional strength. As illustrated in FIG. 4, pegs 20 on the dome-like portion 16 are inserted into holes in the underside 18 of the sheath 12 which are adapted to receive the pegs 20 during the molding process. Also, the dome-like portion 16 may be covered with a padding 21 to further protect the kicker. Alternatively, a metal such as brass would be suitable.

A gripping plate 24 forms the outer surface of the underside 18 of the sheath 12. Gripping means on the outer surface of the gripping plate 24 includes a plurality of detents 14 for registry and frictional gripping of the object to be held, such as the board 10 of FIG. 1. A firm and steady grip on the object may be maintained by frictional engagement of the user's digits with the inner surface of the underside 18 of the sheath 12 and by encircling the palmside of the hand around the edge of the board 10. Further, in the preferred embodiment, to prevent slippage of the hand within the sheath during a martial arts maneuver, the inner surface of the underside 18 is textured roughly. The rough texture 26 can be applied during the molding process or by adhering a suitable non-slip material, such as rubber, to the inner surface of the underside 18 of the sheath 12.

Flange 28 extending perpendicularly from the gripping plate 24 is provided as additional gripping means and support for the object being held as shown in FIG. 1. Another function of the flange 28 is to provide further hand protection for the user. In particular, the flange covers a portion of the palm side of the user's hand and effectively separates that hand portion from the board. The likelihood of hand injuries are thereby decreased substantially by increasing the area of the hand which is covered by the protective sheath 12.

Figure 2:
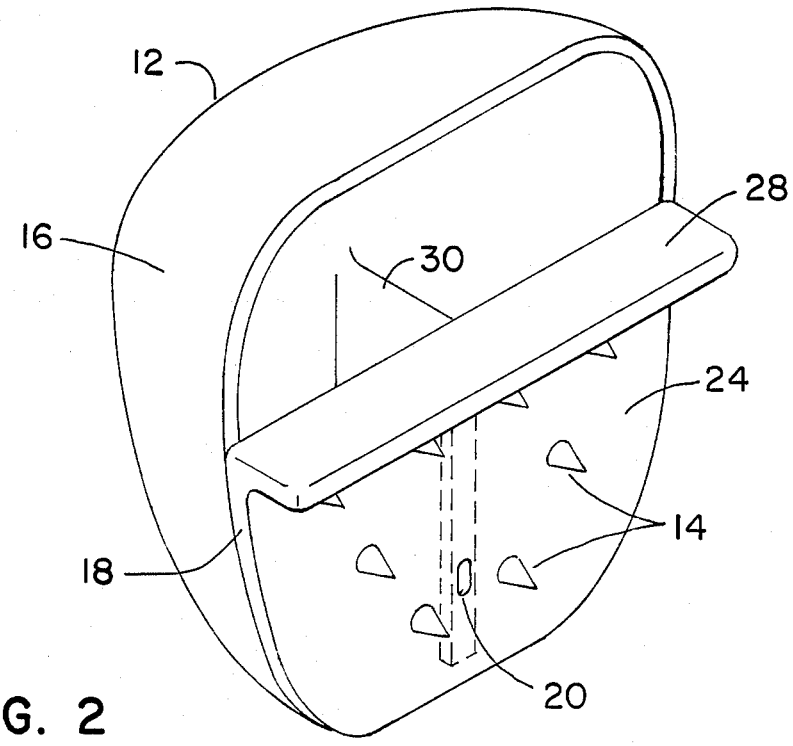
FIG. 2 is an isometric view of the hand protector shown in FIG. 1.

As shown in FIGS. 2–3, a support member 30 within the interior of the protective sheath provides further gripping and supporting means. Support member 30 extends perpendicularly from the inner surface of the sheath and is thus aligned with the user's digits. Being centrally located within the interior of the sheath and aligned with the user's digits, the user may grasp firmly the support member 30 between the two middle digits.

Figure 5:
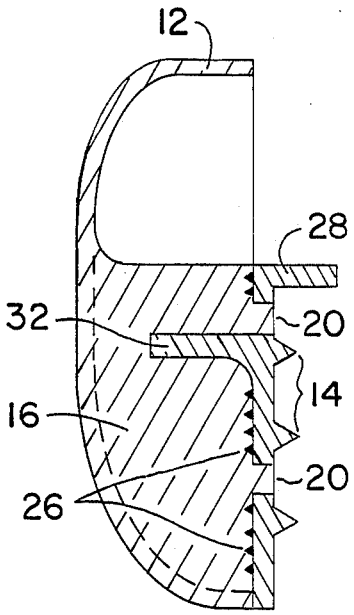
FIG. 5 is a side elevational view of an alternate embodiment of the present invention having a gripping bar.

In an alternate embodiment of the present invention, a gripping bar 32 may be provided. As shown in FIG. 5, a concavo-convex bar is attached to the inner surface of the underside of the protective sheath 12. By grasping the bar within the sheath, the user is able to maintain a tighter and a steadier grip on the object being held. Advantageously, the gripping bar 32 not only provides additional support, but further prevents slippage of the users hand within the sheath 12.

While the above description discloses the preferred embodiments of the invention, it is anticipated that changes may be made without departing from the concepts disclosed herein and, therefore, it is intended that the scope of this invention be limited only by the appended claims.

What is claimed is:

1. A hand protector with gripping means for use in the martial arts, which comprises:

a sheath made of a substantially non-deformable material for enveloping the full digit set of a user's hand, said sheath having a dome-like portion and an underside; and a gripping plate fixedly attached to and covering a portion of the underside of said sheath, the outer surface of said gripping plate including a plurality of detents to provide frictional gripping of an object being held.

2. The invention of claim 1 further comprising a flange extending outwardly from said gripping plate for supporting the object being held and for providing further hand protection.

3. The invention of claim 1 wherein the inner surface of the underside of said sheath is textured to prevent slippage of the user's hand within said sheath.

4. The invention of claim 3 which further comprises a support member fixedly attached to the inner surface of said sheath and extending perpendicularly therefrom, said support member being in alignment with the digits of the user's hand so that it may be held firmly between the two middle digits.

5. The invention of claim 1 further comprising a concavo-convex gripping bar, the ends of said gripping bar being fixedly attached to the inner surface of the underside of said sheath, said gripping bar capable of being grasped by the digits of the user's hand.

6. The invention of claim 1 wherein the outer surface of the dome-like portion of said sheath is covered with a padding material.

7. A hand protector for use in the martial arts comprising:

a sheath made of a substantially non-deformable material, said sheath having a semi ovoid dome-like portion and an underside; and a gripping plate attached to and covering a portion of the underside of said sheath whereby the fingers may be inserted between the dome-like portion and the gripping plate, thereby protecting the hand and allowing the plate to be applied against an object to be held.

8. The invention of claim 7 wherein the outer surface of said gripping plate has a plurality of detents to provide frictional gripping of the object to be held.

* * * * *